United States Patent [19]

Szücs

[11] Patent Number: 4,716,690

[45] Date of Patent: Jan. 5, 1988

[54] APPARATUS AND METHOD FOR CLEANING STONE AND METAL SURFACES

[76] Inventor: Johan Szücs, Hornstrasse 9, 8000 München 40, Fed. Rep. of Germany

[21] Appl. No.: 946,617

[22] Filed: Dec. 29, 1986

Related U.S. Application Data

[63] Continuation of Ser. No. 765,469, Aug. 14, 1985, abandoned.

[30] Foreign Application Priority Data

Aug. 14, 1984 [DE] Fed. Rep. of Germany ..... 34109681

[51] Int. Cl.[4] ..... B24C 1/08

[52] U.S. Cl. ..... 51/321; 51/439

[58] Field of Search ..... 51/319, 439, 436, 438, 51/427, 428, 320, 321 I, 292

[56] References Cited

U.S. PATENT DOCUMENTS

| | | | |
|---|---|---|---|
| 2,532,655 | 12/1950 | Backer | 51/319 |
| 2,605,596 | 8/1952 | Uhri | 51/321 |
| 3,069,812 | 12/1962 | Shelton | 51/427 |
| 3,344,558 | 10/1967 | Kirkland | 51/427 |
| 3,427,763 | 7/1966 | Maasberg | 51/321 |
| 4,020,535 | 5/1977 | Cuneo | 51/319 |
| 4,449,332 | 5/1984 | Griffiths | 51/439 |
| 4,478,368 | 10/1984 | Yie | 51/439 |
| 4,517,774 | 5/1985 | Dudding | 51/319 |

FOREIGN PATENT DOCUMENTS

| | | | |
|---|---|---|---|
| 484524 | 1/1952 | Canada | 51/439 |
| 0069875 | 1/1983 | European Pat. Off. . | |
| 0069874 | 1/1983 | European Pat. Off. . | |
| 206610 | 12/1907 | Fed. Rep. of Germany . | |
| 1245793 | 7/1967 | Fed. Rep. of Germany . | |
| 2724318 | 11/1978 | Fed. Rep. of Germany . | |
| 2948380 | 7/1981 | Fed. Rep. of Germany . | |
| 3204861 | 8/1983 | Fed. Rep. of Germany . | |
| 722464 | of 1955 | United Kingdom | 51/439 |

*Primary Examiner*—Frederick R. Schmidt
*Assistant Examiner*—Bradley I. Vaught
*Attorney, Agent, or Firm*—Armstrong, Nikaido, Marmelstein & Kubovcik

[57] ABSTRACT

The invention relates to a method and apparatus for cleaning stone and metal surfaces by means of a cleaning jet consisting of water, a proportion of air substantially higher by volume and sharp-edged blast material particles. The jet generated in a chamber is set in a rotation such that jointly with the expansion of the air contained therein said jet comprises a relatively wide conical cross-section. This jet permits careful but thorough cleaning of stone and metal surfaces.

14 Claims, 2 Drawing Figures

APPARATUS AND METHOD FOR CLEANING STONE AND METAL SURFACES

This application is a continuation of application Ser. No. 765,469, filed 8/14/85, now abandoned.

BACKGROUND OF THE INVENTION

The invention relates to a method for cleaning stone and metal surfaces and an apparatus for carrying out said method. In particular the invention relates to a method and an apparatus for cleaning surfaces of stone and metal contaminated and corroded by atmospheric influences, for example facades of this type or stone and metal monuments.

The stone surfaces cleaned according to the invention may be both artificial stone surfaces such as concrete surfaces or also natural stone surfaces such as limestone surfaces or granite surfaces.

Because of pronounced air pollution the cleaning of such surfaces like the surfaces of monuments or statues cast usually from bronze is becoming of increasing importance. As a rule, when cleaning such surfaces only the dirt and soil layer should be removed. Usually, the metal layer therebelow corroded by atmospheric pollutants is to be retained.

The important point is to remove as little material as possible. In particular, the stone or metal material disposed therebelow must not be removed. In the case of bronze figures not even the natural patina, if any is present, should be removed.

A cleaning method having the features of the preamble of claim 1 is known from U.S. Pat. No. 3,427,763. In this known cleaning method a pressurized water flow generated by means of a water pressure between 100 and 900 bar in a mixing chamber sucks the blast material in from a passage opening laterally into the mixing chamber, said blast material having a granulation between 0.01 and about 3 mm and consisting of sand, quartz, corundum, flue dust and the like. The water jet acts as water jet pump and in this manner draws in the blast material particles.

The intention is that because the blast material particles are carried by a water jet and thrown against the surface to be cleaned that the blast material particles do not simply strike against said surface to be cleaned. On the contrary, at least mainly, they are to be entrained by the sprayed-on water, slide along the surface and in this manner clean the surface.

An essential disadvantage of this known method is that too much of the material to be worked is removed. Accordingly, the known method is used primarily for cleaning coarse parts, such as castings and the like, and in addition also as separating cutting method in which the water jet charged with blast matrial saws a gap through the workpiece to be severed. Thus, the known method is not suitable for cleaning valuable objects, for example historical buildings, monuments and the like. It is not possible in practice to conduct the known method so that only the upper layer to be removed is in fact removed and the material therebelow is not impaired.

OBJECT AND SUMMARY OF THE INVENTION

The object of the invention is to further develop the known method so that the cleaning of the object surfaces can take place on the one hand more rapidly but on the other in such a manner that removal of parts of the object surface is avoided or is only negligible.

The cleaning is perfect, i.e. no dirt or soil residues are left, and also there is no discolouring or other disadvantageous influencing of the object surface, providing the method is correctly applied.

According to the invention this problem is solved in that the jet apart from the water and the blast material contains a high proportion of air which by volume is several times the proportion of water, that the jet rotates about its axis and that the jet under the influence of the air contained therein under pressure at the start of the jet and of the rotation expands greatly laterally. Thus, the jet emerging from the tool for carrying out the method has substantially the form of a cone in which the angle between the cone axis and one generatrix of the cone surface as a rule is between 20° and 40°.

Due to the fact that the jet contains a high proportion of air it assumes the character of a water-in-air dispersion. The air contained therein under pressure at the start of the jet expands when the jet emerges into the atmosphere and effects the conical fanning of the jet towards all sides. The rotation of the air-blast material-water mixture acts in the same sense. This rotation also uniformly expands the jet radially towards all sides. On the path from the generation point, usually a nozzle, to the surface to be cleaned the cross-section of the jet thus increases approximately proportionally to the square of the distance from the origin of the jet. The velocity component of the jet in the direction of the jet axis, i.e. in the direction of the cone axis, decreases however relatively little because the increase of the flow cross-section of the jet does not take place as in the prior art, if present, by velocity reduction but by expansion of the air contained in the jet. In addition, any velocity reduction in the jet which might occur is compensated by the expansion of the air because this expansion acts of course not only radially outwardly but also in the jet propagation direction.

It has been found that when working with a cleaning agent jet of the type explained not only metal surfaces, in particular bronze surfaces, but also natural and artificial stone surfaces can be easily and safely cleaned. The method according to the invention is particularly suitable for sharp-edged blast material, such as glass powder. Surprisingly, the surface to be cleaned is not unduly removed. On the contrary, the removal remains astonishingly low although perfect removal of the soil layers is effected. Applicants assume that this is due to the fact that the method according to the invention responds to an unusually great extent to different hardnesses in the surface regions of the object to be cleaned. This means that the soft dirt layers are rapidly removed whereas the stone material is hardly attacked by the blast material particles sliding over its surface and no doubt partially executing there circular movements. Consequently, the worker cleaning an object's surface with the apparatus generating a jet according to the invention no longer runs the risk of inadmissibly attacking the object's surface by allowing the jet to continue to act even for a short time on an adequately cleaned surface. This makes it possible to further clean stubbornly soiled areas without having to take excessive care as regards adjacent already cleaned regions.

An essential criterion of the method according to the invention resides in that said method can easily be adapted to the hardness of the surface to be worked and cleaned. If for example a limestone or marble facade is to be cleaned the water pressure and thus also the pressure of the air supplying the blast material will be made low whilst for cleaning hard surfaces, for example granite surfaces or hard bronze surfaces, the pressure may be made relatively high.

A further advantage of the invention compared with the prior art is that a considerable velocity component parallel to the surface to be worked is imparted to the jet material particles not only be the rotation and expansion of the jet prior to impinging on said surface but in addition the removal effect of the blast material in the invention is distributed over a far greater area than was the case with the narrow jets according to the prior art. This also contributes to a particularly mild removing effect. Surprisingly, this only gentle removing effect of the cleaning jet according to the invention is adequate to obtain a rapid perfect cleaning by removal of soil layers.

It is considered essential in the invention to admix an adequately large amount of air. It is obvious that the admixture of smaller amounts of air can only lead to a slight expansion of an approximately cylindrical jet. Accordingly, the air is admixed in such a high proportion that the air contained in the jet is many times by volume the amount of water therein. By volume, the proportion of air in the jet is advantageously about 200 times to 1200 times the water proportion, the air proportion by volume of course greatly increasing in the jet propagation direction due to the expansion of the jet.

By weight, the air proportion remains substantially constant. It is advantageously 0.5 to 3 times the water proportion, and the air proportion should be greater the greater the water pressure. Air proportions from 0.7 to 1.5 have proved suitable.

Accordingly, a cleaning jet according to the invention does not have the relatively dark colour of the water charged with the blast or abrasive material. Such a jet rather has a white appearance.

The jet according to the invention is preferably formed in that in a mixing chamber a mixture under considerable excess pressure of sharp-edge blast material, water and air is generated, said mixture set in rotation about an axis and the rotating mixture sprayed out along the axis. In this manner in the mixing chamber a good mixing of air, blast material and water can be achieved. However, in the mixing chamber a relatively high pressure is maintained which is also utilized to eject the jet from the mixing chamber unless this ejection is effected by retaining the kinetic energy of the water jet entering the mixing chamber.

Because the air in the mixing chamber is still at a pressure only slightly below the pressure at which it was introduced into said mixing chamber, its volume remains correspondingly small. Immediately after emergence of the blast-material water-air mixture from the mixing chamber into the ambient atmosphere the air can expand and thus radially expand the jet.

Preferably, the method is carried out in such a manner that a pressurized water jet is injected into the mixing chamber at the side thereof opposite the exit nozzle in the direction towards said nozzle and that a pressurized air flow entraining blast material is directed from the side obliquely forwardly against the water jet in such a manner that the jet centre axis of the air jet and the jet centre axis of the water jet extend in spaced relationship from each other. Due to the eccentric impingement of the flows on each other a considerable rotation is generated in the mixing chamber.

Fundamentally, the rotation can also be differently generated, for example by injecting the water tangentially into a mixing chamber. However, the rotation is preferably generated in the manner explained above. This has the essential advantage that the rotation generated is not excessive because if it is the blast material particles would be entrained too much into the outer edge regions of the jet generated. However, in the preferred embodiment of the invention in which the mixing chamber tapers conically towards the exit nozzle this is counteracted by the fact that in the mixing chamber as well blast material particles rotating near the periphery thereof on their way to the nozzle are given a movement component directed radially inwardly towards the mixing chamber axis. In this manner the blast material particles are very uniformly distributed in the conically expanded jet so that the cleaning effect of said jet occurs over the entire impingement cross-section thereof on the surface to be cleaned.

Preferred parameters for performing the method according to the invention can include the water pressure prior to entry into the chamber being about 70 to 130 bar, the excess pressure of air with the blast material is supplied is about 3 to 8%, preferrably about 5% of the water pressure, and that a ratio of 11 kg of blast material to 3 to 50 kg of water is supplied, preferrably 1 kg to 6 kg of water.

The blast or abrasive material is preferably ground glass powder which is correspondingly sharp-edge and has a granulation between 0 and 1 mm, preferably between 0 and 0.5 mm.

The invention also relates to an apparatus for carrying out the method. With such an apparatus execution of the method according to the invention is relatively simple. To obtain the desired jet structure firstly only the water supply is set with the desired pressure, for example 50 bar. The blast-material air supply is then connected and the pressure of the air entraining the blast material increased until the initially rod-shaped jet leaving the exit nozzle becomes white and assumes the form of a cone. The jet has now the structure used according to the invention which has the essential advantages explained above as regards the cleaning even of sensitive surfaces.

It is essential in the invention to use a blast material which is sharp-edged. The importance of sharp edges is shown by the fact that the reuse of glass powder used once as blast material leads to a comparatively poorer cleaning effect and, with correspondingly more intense action, to greater removal of the object surface to be cleaned. Accordingly, glass powder is used as blast material preferably only once.

Fundamentally, of course, other materials such as ground quartz or ground flint can be used. This is however more complicated. The same applies to the use of corundum or other commercially usual abrasive powders.

The best results were achieved when the blast material had grains of different magnitude up to 1 mm, preferably up to 0.5 mm. The use of grains of different magnitude leads to better cleaning action than that of grains of identical magnitude. Preferably, the grain size of the blast material is distributed in accordance with a normal distribution curve over the range from 0 up to the maximum size. With regard to the term normal distribution curve reference is made to the book "Introduction to Granulation Measurement Techniques" by Bartel (Springer Publications, Berlin, Göttingen, Heidelberg, 1964), pages 13 and 14.

The path of the normal distribution curve is preferably such that about half (by weight) of all the grains have a size between one third and two thirds of the maximum size. With the preferred granulation of the sharp-edged irregularly shaped grains of the blast material half thereof should thus have a granulation between 0.17 mm and 0.33 mm.

BRIEF DESCRIPTION OF THE DRAWINGS

The subject of the invention will be explained with the aid of the attached schematic drawings of a preferred example of embodiment illustrated therein. In the drawings.

DETAILED DESCRIPTION OF THE INVENTION

Figure 1:
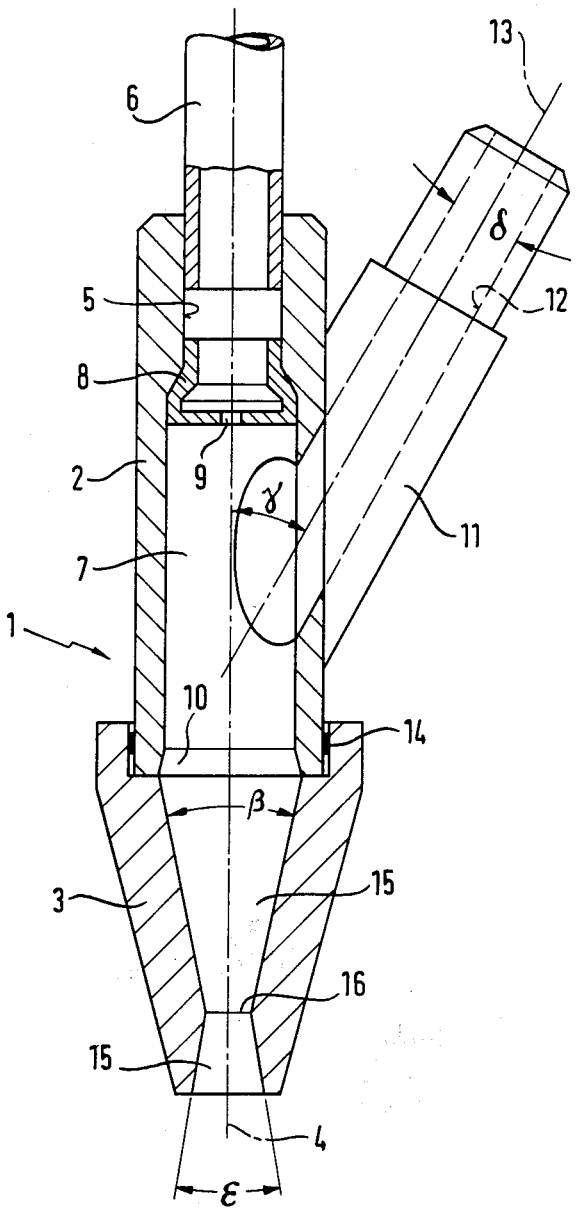
FIG. 1 shows the mixing head of an apparatus according to the invention in elevation and FIG. 2 shows the mode of operation of the mixing head of FIG. 1.

FIG. 1 shows a mixing head 1 made up of a number of individual parts. These individual parts, which will be explained in detail hereinafter, are fixedly connected together, for example screwed, soldered, welded, adhered and the like.

The mixing head 1 consists of two main parts, that is a substantially cylindrical chamber sleeve 2 and a substantially conically tapering nozzle body 3 tightly fitted thereon.

The chamber sleeve 2 and the nozzle body 3 are each made rotational symmetrical with respect to a common major axis 4.

The chamber sleeve 2 comprises a first portion having a bore 5 which is coaxial with the major axis 4 and in which a tube member 6 is sealingly screwed or inserted. Said tube member 6 extends from one end of the chamber sleeve 2 only over less than the first half of the bore 5.

The second portion of the chamber sleeve 2 comprises a bore likewise coaxial to the major axis 4 whose interior forms a chamber 7. The diameter of the chamber 7 is greater than the diameter of the bore 5, from which a frusto-conically bevelled transition leads into the chamber 7.

Inserted or screwed from the chamber 7 into the end of the bore 5 opening into the end of said chamber 7 is a nozzle member 8. Said nozzle member 8 is constructed as relatively thin-walled hollow body having a tube member engaging in the bore 5, a short transition portion adjoining said tube member in the direction of the chamber 7 and widening frusto-conically and a cylindrical end tube member which is disposed in the chamber 7 and is substantially sealed by a wall extending transversely of the major axis 4. Said wall is penetrated by a central water entry nozzle 9 which is formed by a substantially cylindrical bore coaxial to the major axis 4.

The other end of the chamber 7 facing the nozzle body 3 has a short frusto-conically widening transition 10.

The tube member 6 is itself made relatively thin-walled and represents the water supply line.

The side wall of the chamber 7 is traversed approximately in its centre region by the bore 12 of a blast material supply tube member 11 which is made substantially cylindrical and disposed coaxial to the bore 12 and has with the latter a common centre axis 13.

In the illustration in the plane of the drawing the centre axis 13 forms with the major axis 4 an angle $\gamma$ and intersects said axis at a point which is spaced from the end of the chamber 7 facing the nozzle body a distance which is approximately one quarter of the total length of the chamber 7.

The centre axis 13 extends however behind the major axis 4 and is thus offset with respect to the latter by a certain amount in the viewing direction of FIG. 1. This amount is however preferably smaller than the radius of the chamber 7 at the point of intersection of the two axes 4 and 13.

The blast material supply tube member 11 is stepped at its end remote from the chamber 7 so that a blast-material air-supply hose (not shown) can be clamped to the reduced diameter end.

The bore 12 coaxially passing through the stepped end and the remaining portion of the blast material supply tube member 11 widens conically from the free end of the tube member 11 towards the opening into the chamber 7, a corresponding cone having an apex angle $\gamma$.

The nozzle body comprises a first short portion of cylindrical peripheral surface and adjoining the latter a substantially longer portion with frusto-conically tapering outer surface. The cylindrical portion is drilled out from its end so that said portion can be secured over the facing end of the chamber 7 with interposition of a seal 14 which can also be formed by a soldered or welded joint.

The end of the bore of said portion facing the interior of the nozzle body 3 is stepped so that the facing end of the chamber sleeve 2 fits flush.

The major portion of the nozzle body 3 comprises an initially tapering and then again widening nozzle bore 15. The first portion thereof opens into the bore of the portion of the nozzle body 3 surrounding the chamber sleeve 2 with an entry diameter which is equal to the diameter with which the transition 10 opens into the facing end of the chamber sleeve 2.

From this point on the nozzle bore 15 tapers conically, the corresponding bore having an apex angle $\beta$ up to a narrow point 16 from whence the nozzle bore 15 again conically widens up to the free end of the nozzle body 3 with an apex angle $\epsilon$ for the corresponding cone.

Thus, originating from the water entry nozzle 9 up to the remote end of the nozzle body 3 an inner space is formed which is rotational symmetrical with respect to the major axis 4 and which extends firstly over the length of the chamber 7 cylindrically, then conically widens near the end thereof, then conically tapers in the adjoining nozzle body gradually up to the narrow point 16 and from there again conically widens until the exit from the nozzle body 3.

In a preferred example of embodiment the chamber sleeve 2 comprises a total length of 90 mm, the bore 5 having substantially a diameter of 6.35 mm, the chamber 7 a diameter of 21 mm, the opening from the chamber sleeve 2 to the nozzle body 3 an opening diameter of 24 mm, the narrow point a diameter of 8 mm and the opening of the nozzle bore 15 from the nozzle bore 3 to the atmosphere a diameter of 12 mm.

The thin-walled tube member 6 inserted into the bore 5 comprises an internal diameter of about 5 mm; the cylindrical portion of the nozzle member 8 comprises a somewhat smaller internal diameter.

Between the facing ends of the tube member 6 and the nozzle member 8 a gap is formed which corresponds to about one quarter of the length of the bore 5.

The water entry nozzle 9 has a diameter of about 0.55 mm. The length of the bore 5 is about 26 mm and the adjoining length of the chamber 7 together with the transition 10 is about 64 mm. The length of the conically tapering nozzle bore up to the narrow point 16 is 40 mm, the length of the widening nozzle bore 15 is 12 mm and the distance between the water entry nozzle and the widened end of the chamber 7 is about 60 mm. The angles $\beta$ and $\epsilon$ can be calculated from the above quantities, $\beta$ being about 23° and $\epsilon$ about 10°.

The centre axis 13 is inclined to the major axis 4 by about 45°, passing behind the latter at a distance to the facing end of the bore 5 which is 44 mm.

The blast material supply tube member comprises in its portion adjacent the chamber sleeve 2 an external diameter of 25 mm whilst the stepped portion has an external diameter of 18 mm. The bore 12 widens, starting from the free end of the blast material supply tube member 11, where its diameter is 10 mm, up to the passage through the wall of the chamber sleeve 2 where the diameter is 15 mm. This corresponds to an angle $\delta$ of about 3.5°.

Figure 2:
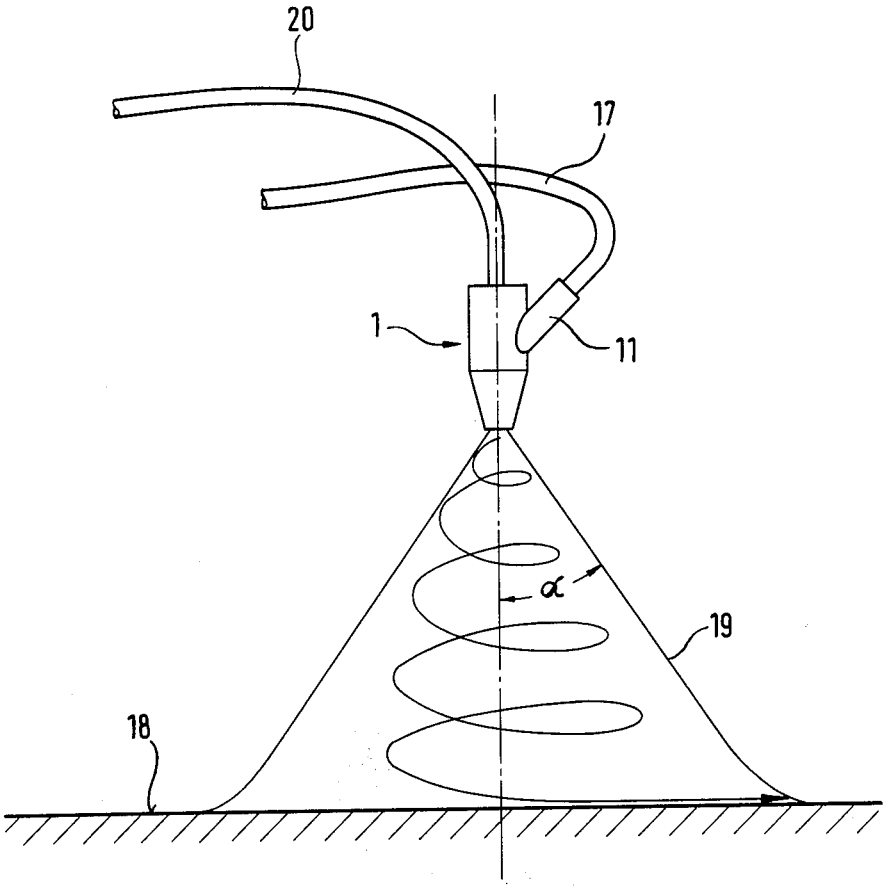

The mode of operation of the mixing head 1 is illustrated in FIG. 2.

The mixing head 1 is connected to a pressure water supply line 20 and an air/blast material supply line 17.

From the free end of the nozzle bore 15 (FIG. 1) facing a surface 18 to be cleaned by schematically illustrated jet emerges in which water droplets and sharp-edged blast material grains are suspended in air.

The emerging jet 19 comprises a relatively frustoconical form and is concentric to the major axis 4. The angle $\alpha$ between the latter and the generatrix of the cone formed by the jet 19 is about 35°.

The blast material particles in this jet 19 cover a helically and plane-spirally extending curve illustrated by a curved arrow in the course of which they impinge on the surface 18 to be cleaned almost tangentially but with high velocity.

The form of the jet 19 depends on the structure of the mixing head 1 of FIG. 1 and on maintaining certain operating parameters. Water is injected under high pressure through the water injection nozzle 9 into the chamber 7 whilst at the same time blast material is injected through the bore 12 with large amounts of air into the chamber 7. Since air and blast material meet the axially moving water droplets outside their joint centre axis they set the latter and themselves in a violent circular motion. At the same time the water mist is traversed by the large amounts of air and still further split up.

The relatively narrow constriction ensures that in the interior of the chamber 7 a relatively high pressure is always maintained which guarantees intimate mixing of the individual components.

On passage through the nozzle bore 15 firstly the velocity of the individual components increases but their spin with respect to the major axis 4 is maintained. After emerging from the nozzle bore 15 water droplets and blast material particles are rapidly urged outwardly firstly by the centrifugal force but then also by the expansion of the included air whilst at the same time their velocity in the direction of the major axis 4 decreases if at all only gradually.

If during operation of the mixing head 1 the parameters of the water pressure, air pressure, amount of water, amount of air and amount and granulation of the blast material are varied then after diffuse atomization of the jet when admissible ranges are reached suddenly a stable jet arises with the properties explained with the aid of FIG. 2 which has the cleaning properties described above.

For the mixing head shown in FIG. 1 and the specified water pressures of 40.2 and 99 bar the following parameters have been found particularly advantageous:

| | | |
|---|---|---|
| Water pressure (bar) | 40.2 | 99 |
| Gas powder (kg/min) | 1.5 | 3.2 |
| Water amount (l/min) | 6.7 | 8.2 |
| Air amount ($m^3$/min) | 1.5 at 2.5 bar | 2.2 at 4.5 bar |
| Granulation of the glass (mm) | 0.01 to 0.2 | no influence preferred 1.5 |
| Air pressure (bar) | 2.5 | 4.5 |

I claim:

1. Method for cleaning stone and metal surfaces, in particular such surfaces contaminated and corroded by atmospheric influences, by applying to such surfaces a jet containing air, water and a fine grain mineral blast material having a grain size of up to 1 mm, said jet being produced by:

supplying water at a pressure in the range from about 70 to 130 bar through a vaporizing entry nozzle into a mixing chamber at a side opposite an exit nozzle in the direction toward said exit nozzle, and directing pressurized air entraining said blast material into said mixing chamber from the side obliquely forwardly against the water flow direction in such a manner that the center axis of the air flow and the center axis of the vaporized water flow extend in spaced relationship to each other thereby generating violent circular motion while mixing said air, water and blast material and further vaporizing the water, the pressure of the air in which said blast material is entrained being about 3 to 8% of the water pressure, the proportion of air by volume being many times the proportion of water, upon leaving said exit nozzle, said jet rotating about its axis and expanding greatly to form a rotating conical stream due to expansion of the air contained therein under pressure and the violent circular motion induced in the mixing chamber whereby said blast material follows a helically and plane-spirally extending curve.

2. Method according to claim 1, wherein the proportion of air is from 200 to 1200 times by volume the proportion of water.

3. Method according to claim 1, wherein the air pressure is about 5% of the water pressure.

4. Method according to claim 1, wherein a ratio of blast material to water is in a range of from 3 to 50 by weight.

5. Method according to claim 4, wherein said ratio is about 6.

6. Method according to claim 1, wherein the blast material is produced from coarse material by breaking.

7. Method according to claim 6, wherein the hardness of the blast material corresponds to that of commercially available glass.

8. Method according to claim 7, wherein the blast material is glass powder.

9. Method according to claim 1, wherein the blast material comprises grains of different size up to 1 mm.

10. Method according to claim 9 wherein the grain size of the blast material is distributed over the range from zero to the maximum size in accordance with a normal distribution curve.

11. Method according to claim 10, wherein about half by weight of all the grains have a size between about one third and two thirds of the maximum size.

12. Method according to claim 1, wherein the blast material comprises grains of different size up to 0.5 mm.

13. Method according to claim 12, wherein the grain size of the blast material is distributed over the range from zero to the maximum size in accordance with a normal distribution curve.

14. Method according to claim 13, wherein about half by weight of all the grains have a size between about one third and two thirds of the maximum size.

* * * * *

UNITED STATES PATENT AND TRADEMARK OFFICE

CERTIFICATE OF CORRECTION

PATENT NO. : 4,716,690

DATED : January 5, 1988

INVENTOR(S) : Johan SZUCS

It is certified that error appears in the above-identified patent and that said Letters Patent is hereby corrected as shown below:

On cover page, Item [30], delete "[DE] Fed. Rep. of Germany .... 34109681" and substitute therefor -- [EP] Europe .... 84109681.1 --.

Signed and Sealed this

Twenty-first Day of September, 1993

Bruce Lehman

*Attest:*

BRUCE LEHMAN

*Attesting Officer*

*Commissioner of Patents and Trademarks*